United States Patent [19]

Marcil

[11] 4,215,705

[45] Aug. 5, 1980

[54] CIGARETTE MAKING MACHINE

[76] Inventor: Raymond Marcil, 2345 Lacordaire, Montreal, Quebec, Canada, H1N 2L7

[21] Appl. No.: 964,809

[22] Filed: Nov. 29, 1978

[51] Int. Cl.[2] ..... A24C 5/42

[52] U.S. Cl. ..... 131/70

[58] Field of Search ..... 131/70–75

[56] References Cited

U.S. PATENT DOCUMENTS 3,764,011 7/1973 Kappeler et al. ..... 131/72

FOREIGN PATENT DOCUMENTS 651583 11/1962 Canada ..... 131/70

749157 12/1966 Canada ..... 131/70

875897 7/1971 Canada ..... 131/70

*Primary Examiner*—V. Millin

[57] ABSTRACT

A cigarette making machine is disclosed. The machine comprises a housing, a tobacco chamber located in the housing, an opening in the housing for introducing a batch of tobacco in such chamber, a press plate movable in the chamber for compressing the batch of tobacco into a substantially cylindrical body, a cam plate pivotally mounted on the housing and engaging the press plate, an actuating member connected to such cam plate for operating the cam plate, a tube supporting means aligned and communicating with the chamber, a plunger slidably mounted in the housing and extending through the chamber, and link means interconnecting the plunger to the actuating member and operated by the cam plate. Rotation of the actuating member first causes the press plate to compress the batch of tobacco and then advances the plunger through the chamber to expel the tobacco body into a cigarette tube mounted on the tube supporting means.

3 Claims, 8 Drawing Figures

CIGARETTE MAKING MACHINE

This invention relates to a cigarette making machine.

BACKGROUND OF THE INVENTION

Cigarette making machines of the type adapted to compress a batch of tobacco into a substantially cylindrical body and to transfer the tobacco body into a prefabricated cigarette tube have been known for years. However, the existing machines are normally actuated by means of a crank arm which extends substantially out of the machine and by a complicated mechanism which adds to the cost of the machine.

SUMMARY OF THE INVENTION

It is therefore the object of the present invention to provide a cigarette making machine which is compact and includes a minimum number of operating parts, thus reducing the manufacturing cost.

The cigarette making machine, in accordance with the invention, comprises a housing, a tobacco chamber located in such housing, an opening in the housing for introducing a batch of tobacco in the chamber, a press plate movable in the chamber for compressing the batch of tobacco into a substantially cylindrical body, a cam plate pivotally mounted on the housing and engaging the press plate, an actuating member connected to the cam plate for operating the cam plate, tube supporting means aligned and communicating with the chamber, a plunger slidably mounted in the housing and extending through the chamber, and link means interconnecting the plunger to the actuating member and operated by such cam plate, whereby rotation of the actuating member first causes the press plate to compress the batch of tobacco and then advances the plunger through the chamber to expel the tobacco body into a cigarette tube mounted on the cigarette tube supporting means.

In a preferred embodiment of the invention, the link means includes two arms pivotally interconnected at one end and having their opposite end pivotally connected to the axis of said cam and to the plunger, respectively. An abutment means extends from the cam and engages one of such arms to pivot such one arm around the shaft of the cam and so move the plunger.

SHORT DESCRIPTION OF THE DRAWINGS

The invention will now be disclosed, by way of example, with reference to the accompanying drawings in which.

DESCRIPTION OF A PREFERRED EMBODIMENT

Figure 1:
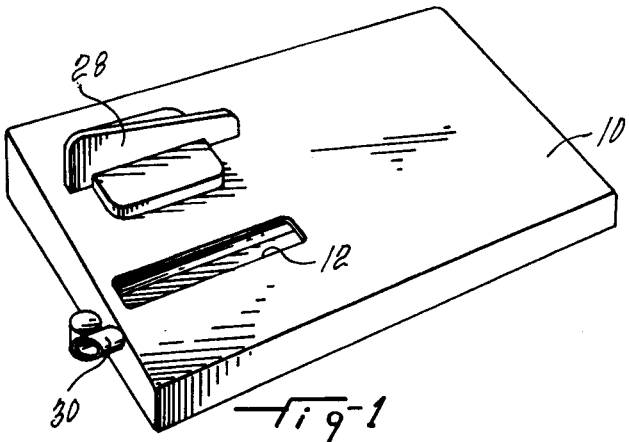
FIG. 1 illustrates a perspective view of a cigarette making machine in accordance with the invention.
Figure 2:
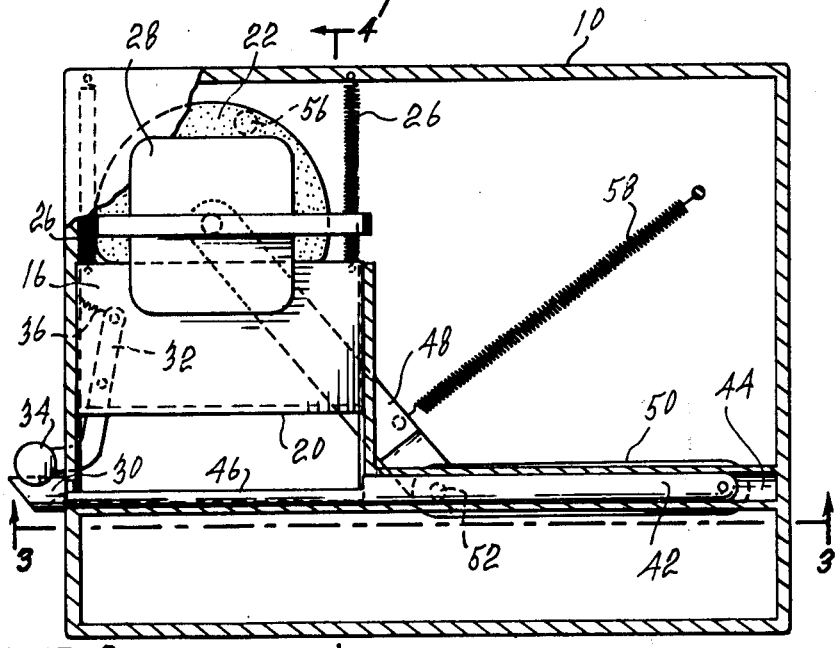
FIG. 2 illustrates a top view, with the cover removed, of the cigarette making machine shown in FIG. 1.
Figure 3:
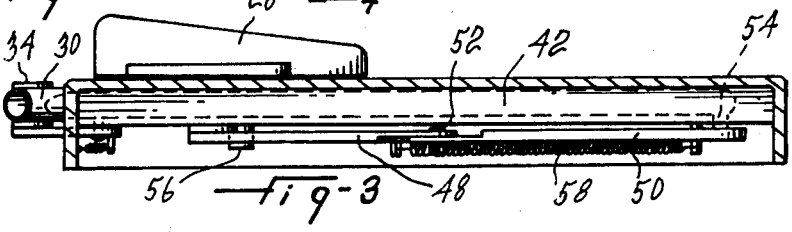
FIG. 3 illustrates a view taken along line 3—3 of FIG. 2.
Figure 4:
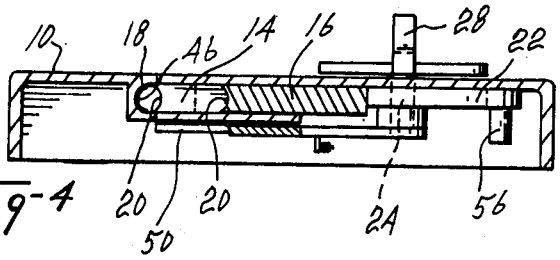
FIG. 4 illustrates a view taken along line 4—4 of FIG. 2.

Referring to the drawings, there is shown an embodiment of a cigarette making machine comprising a housing 10 made of any suitable material, such as metal or plastic, having an opening 12 communicating with a chamber 14 integral with the housing. Opening 12 is for introducing shredded tobacco into the chamber 14. A press plate 16 is slidably mounted in the chamber 14 for compressing the tobacco. The face 18 of the housing and the face 20 of the press plate are semi-circular in construction so as to compress the batch of tobacco into a substantially cylindrical body. A cam plate 22 mounted on a shaft 24 is rotably mounted on the housing for actuating the press plate against the biasing action of springs 26 interconnecting the press plate to the housing. An actuating member 28 is mounted on shaft 24 for operating the cam plate 22.

Figure 5:
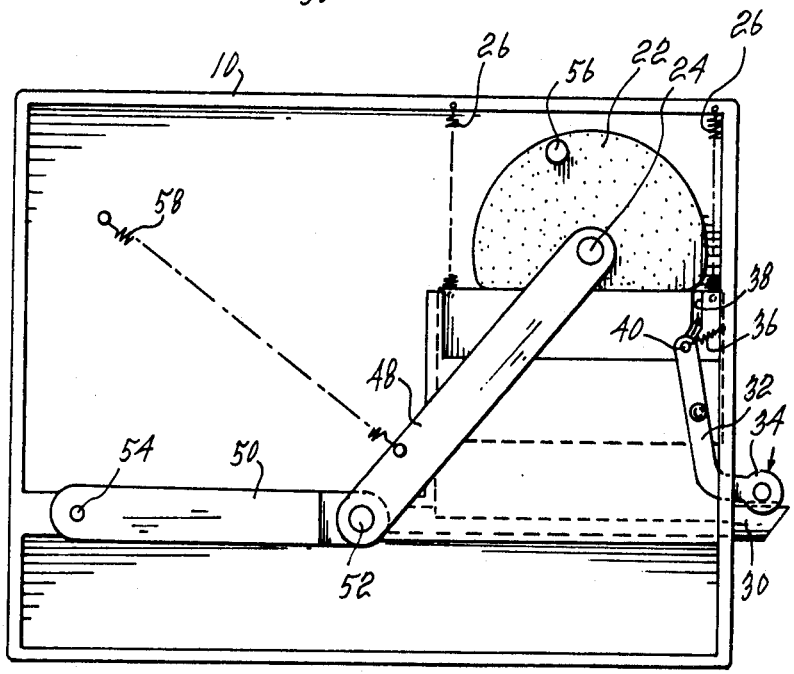
FIG. 5 illustrates a bottom view of the cigarette making machine shown in FIG. 1.
Figure 6:
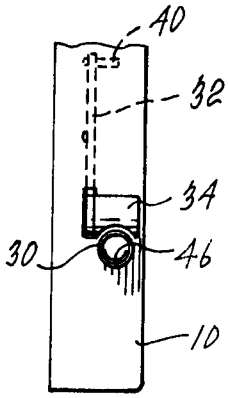
FIG. 6 illustrates a side view of a portion of the cigarette making machine of FIG. 1.

A tube supporting means 30 is mounted on the side of the housing and communicates with the chamber 14 in alignment with the face 18 thereof for a reason which will become obvious later on in the description. An arm 32 is pivotally mounted on the housing and provided with a head 34 engaging tube supporting means 30 for holding cigarette tubes on the tube supporting means under the action of a spring 36 interconnecting the other end of the arm 32 to the housing. As shown in FIG. 5, a slot 38 is provided in the press plate 16 and a pin 40 is located at the end of arm 32 for holding head 34 away from the tube supporting means when the press plate is retracted so as to permit insertion of a cigarette tube onto the cigarette tube supporting means.

A plunger 42 is slidably mounted in a cavity 44 molded into the housing. Plunger 42 has a semi-circular portion 46 extending through the chamber along the wall 18. The plunger is in alignment with the cigarette tube supporting means for a reason which will become obvious later on in the description.

A link including arms 48 and 50 is provided for operating the plunger 38. Arms 48 and 50 are pivotally interconnected at 52 and their opposite ends are pivotally connected, respectively, to the shaft 24 of the cam plate 22 and to the plunger 42 at pivot point 54. An abutment means 56 is provided on the cam plate 22 for engaging arm 48 and operating the same against the action of a spring 58 interconnecting arm 48 and the housing. A slot 60 is provided at the bottom of cavity 44 for allowing sliding of the plunger pivot 54 along the cavity.

Figure 7:
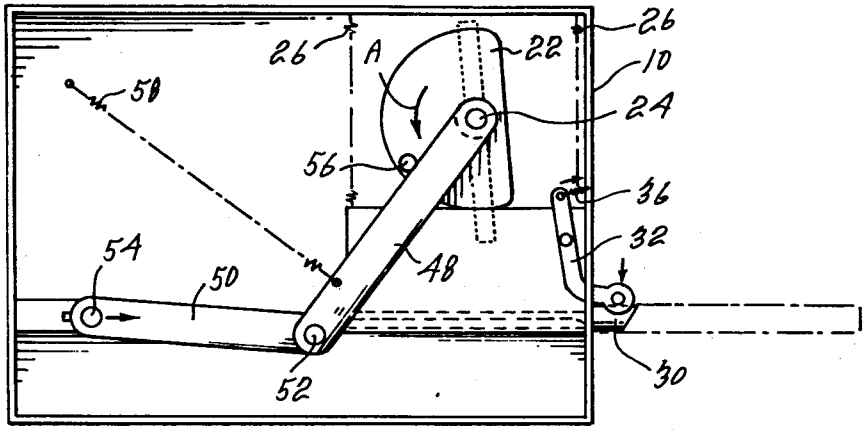
FIGS. 7 and 8 illustrate a bottom view such as in FIG. 5 showing the operation of the cigarette making machine.
Figure 8:
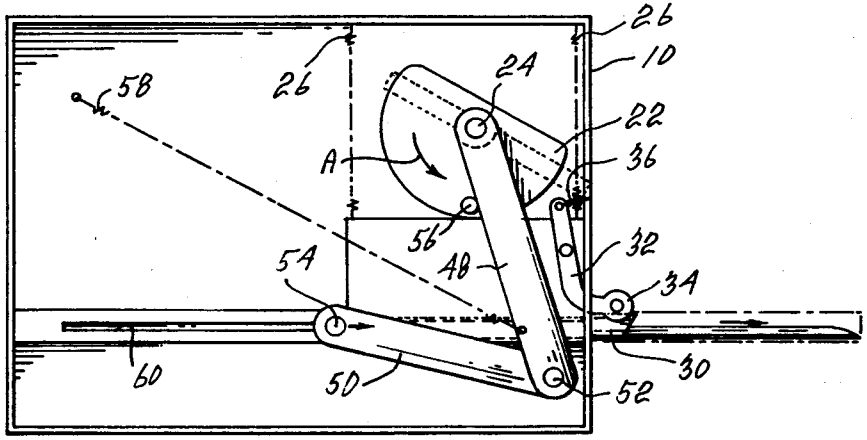

In operation, the chamber 14 is first filled with shredded tobacco and a cigarette tube inserted over the tube supporting means. The actuating member 28 is then rotated in the direction of arrow A in FIG. 7. During the first 90° rotation of the actuating member, the press plate 16 is moved by cam 22 to compress the shredded tobacco between semi-circular faces 18 and 20 to form a cylindrical body of tobacco. Upon continued rotation of the actuating member 28, as shown in FIG. 8, the abutment member 56 contacts the arm 48 to move arm 50 and plunger 42 so as to push the plunger through the chamber 14 and out of the opening in the tube supporting means 30. This operation will eject the tobacco body out of the chamber and into the cigarette tube. Upon rotation of the actuating member 28 back to its original position, the press plate 16 will be withdrawn by springs 26 and pin 40 of the lever 32 will ride in slot 38 of the press plate to move head 34 from tube retaining means 30 to free the cigarette tube.

Although the invention has been disclosed with reference to a preferred embodiment, it is to be understood that modifications of such embodiment are envisaged. For example, the tobacco chamber 14 and the cavity 44 for the plunger need not be integral with the housing. In addition, other types of link means suitable for operation by the actuating member 28 are also envisaged.

What I claim is:

1. A manually-operated cigarette making machine comprising a housing having a top wall and side walls, an elongated tobacco housing located in said housing and having an access opening in the top wall of said housing, a nipple secured to a side wall of said housing and protruding therefrom and in communication with said chamber, being in alignment with one longitudinal edge thereof, a press-plate movable in, and transversely, of said chamber between a retracted position and an operative position close to said longitudinal edge of said chamber, whereby tobacco placed in said chamber through said access opening, is compressed into a substantially cylindrical body against said longitudinal edge of said chamber, spring means biasing said press-plate into said retracted position, an upright shaft journalled in the top wall of said housing and extending therethrough, a cam plate located in said housing, secured to said shaft and having an outer cam edge directly engaging said press-plate, an actuating lever entirely disposed above said top wall of said housing and secured to the upper end of said shaft, and not protruding radially from any of said side walls in the retracted position of said press-plate, a plunger slidably mounted in said housing in alignment with said nipple and movable longitudinally through said chamber from a retracted position to an advanced position to push tobacco compressed in said chamber by the press-plate out of the said nipple into a receiving paper cigarette tube held on said nipple, first and second arms pivotally interconnected at one end and having their opposite end pivotally connected to said shaft and to said plunger, respectively, an abutment means rigidly secured to said cam plate, radially spaced from said shaft and engageable with said first arm, initial rotation of said cam plate by said actuating lever first moving said press-plate from said retracted position to said operative position and further rotation of said cam plate causing said abutment means to engage said first arm and rotate the same about said shaft to thereby cause said plunger to move from its retracted position to its advanced position, first spring means biasing said press-plate into its retracted position and second spring means biasing said plunger into its retracted position.

2. A manually-operated cigarette making machine as defined in claim 1, further comprising means for holding a paper cigarette tube onto said nipple, said means consisting of a substantially L-shape arm pivotally mounted in said housing and having a head disposed exteriorly of said housing opposite the side of said nipple and engageable with a paper cigarette tube fitted on said nipple, said arm extending through an opening in a side wall of said housing and having an inner end, a pin secured to said inner end, said press-plate having a slot engaged by said pin, said slot having a first portion extending parallel to the direction of movement of said press-plate and a second portion inclined to said first portion and spring means attached to said L-shape arm and to said housing and biasing said L-shape arm into a paper cigarette tube holding position, whereby when said press-plate is in said operative position, said head retains a paper cigarette tube placed on said nipple and when said press-plate is in retracted position, said head is pivoted away from said nipple.

3. A manually-operated cigarette making machine as claimed in claims 1 or 2, further including a cavity formed in said housing and in communication with said chamber, said cavity slidably receiving said plunger and having a longitudinal slot, a pivot pin secured to said plunger and slidably in said slot, said pivot pin forming the pivotal connection of said second arm to said plunger.

* * * * *